US006301908B1

(12) United States Patent
Huffman et al.

(10) Patent No.: US 6,301,908 B1
(45) Date of Patent: Oct. 16, 2001

(54) APPARATUS AND METHOD FOR MAKING AND DISPENSING ICE

(75) Inventors: John Huffman, Fenton; Ronald P. Petersen, Arnold; Mark R. Henning, St. Charles; Gregory G. Stettes, Pacific; Franklin D. Newkirk, Florissant, all of MO (US)

(73) Assignee: Crane Co., Stamford, CT (US)

( * ) Notice: Subject to any disclaimer, the term of this patent is extended or adjusted under 35 U.S.C. 154(b) by 0 days.

(21) Appl. No.: 09/415,092

(22) Filed: Oct. 8, 1999

(51) Int. Cl.[7] ..... F25C 5/18
(52) U.S. Cl. ..... 62/137; 62/233
(58) Field of Search ..... 62/71, 137, 233, 62/158

(56) References Cited

U.S. PATENT DOCUMENTS

| | | | | |
|---|---|---|---|---|
| 4,227,377 | * | 10/1980 | Miller | 62/233 |
| 4,622,826 | * | 11/1986 | Tsukiyama et al. | 62/233 |
| 4,741,173 | | 5/1988 | Neumann | 62/298 |
| 4,787,539 | * | 11/1988 | Uchida et al. | 62/137 |
| 4,803,847 | * | 2/1989 | Koeneman et al. | 62/137 |
| 5,090,210 | | 2/1992 | Katayanagi et al. | 62/135 |
| 5,142,878 | * | 9/1992 | Hida et al. | 62/233 |
| 5,697,222 | | 12/1997 | Lee | 62/66 |
| 5,823,001 | | 10/1998 | Patrick et al. | 62/135 |
| 5,829,257 | | 11/1998 | Newmann et al. | 62/73 |
| 5,829,263 | | 11/1998 | Park | 62/177 |

* cited by examiner

*Primary Examiner*—William E. Tapolcai
(74) *Attorney, Agent, or Firm*—Hughes & Luce, L.L.P.

(57) ABSTRACT

An ice making device including a control system to regulate the dispensing of manufactured ice to a hopper for subsequent dispensing into a container such as a cup. The control system senses a low level of ice in the hopper and initiates a signal that is sent to a controller. The controller initiates a time delay that prevents discharge of ice from the ice making device to the hopper until a monitored variable about the ice meets a predetermined value. When the value is reached, additional ice is dispensed to the hopper. Such an ice making device has use in combination with a beverage dispensing device.

10 Claims, 2 Drawing Sheets

APPARATUS AND METHOD FOR MAKING AND DISPENSING ICE

BACKGROUND OF THE INVENTION

The present invention relates to an ice making apparatus and method particularly adapted for use in conjunction with automatic beverage dispensers or other devices requiring frequent dispensing of small quantities of ice. It is also particularly adapted for ice makers utilizing small hoppers relative to the total amount of ice dispensed which typically make ice continuously during an ice making cycle.

Automatic ice makers are well known in the art and are available in many forms and typically have hoppers for temporary storage of manufactured ice. Beverage dispensers of the coin operated type, dispense both ice and beverage when the requisite amount of money is provided and a beverage selection is made. A cup is automatically dispensed, ice is fed to the cup and then beverage is dispensed to the cup. Such vending machines are commonly used in cafeterias and break rooms. A typical vending machine is a model 328 from Crane National Vendors. Many ice makers have control systems to improve their operation and/or efficiency. Typically, the ice maker will cease making ice when the ice bin is full and commence ice making when the ice level in the hopper reaches a low level. Such a control system does not readily adapt itself to ice makers having small hoppers, for example, a four pound capacity hopper, relative to the amount of ice dispensed, like ice makers associated with coin operated beverage dispensers. Nor is such a control system well adapted for ice makers where the amount of dispensed ice varies, sometimes significantly, throughout a day or by day of week. Ice makers using such control systems can produce poor quality ice and present operational problems such as ice clumping. When ice is retained in a hopper for an extended period, it tends to clump together forming large blocks of ice that cannot be dispensed requiring its removal sometimes leaving an empty or nearly empty hopper and thereby potentially unable to meet demand. Also, the ice feeder in the hopper may break the clumped ice and unclumped ice degrading its quality by leaving pieces that are too large or small and may also warm the ice.

Clumping can occur at night, over weekends or during other periods when the rate of ice dispensing is reduced. Generally, ice makers associated with vending machines function such that ice in the hopper is not being moved or mixed unless dispensing is occurring or ice is being made which lack of movement can also encourage clumping. Clumping can be due to the temperature in the hopper rising during periods of non-dispensing and non-mixing allowing localized melting of the ice followed by refreezing. Additionally, the weight of the ice itself can cause localized melting also followed by refreezing. Further, continued mixing, as discussed above, can warm the ice, providing conditions which can lead to later clumping and can also degrade the ice quality through breakage.

The ice quality problem is exacerbated by current control systems operating in a manner such that when the low ice level is attained, the ice maker is activated and makes ice until the high level sensor turns off the ice maker. No accommodation is provided with such a control method to accommodate fluctuating ice demand during extended operating periods. Lack of ice and poor quality ice presents consumer acceptance problems.

Ice makers are many times part of vending machines that are on service routes. Should an ice maker become nonfunctional, e.g., because of ice clumping, it may be several days between visits by a service person to remedy the situation. A vending machine may then be out of service for extended periods of time causing consumer inconvenience.

The apparatus of the present invention includes a control system that is operable to commence ice making upon two or more operating conditions being met with one of the operating conditions being a low ice level in the hopper. The use of two or more operating conditions for control of ice making accommodates fluctuating ice demand and thereby improves operation and ice quality.

SUMMARY OF THE INVENTION

Among the several objects and features of the present invention may be noted the provision of a device for making ice that utilizes at least two operating parameters to control commencement of ice making; the provision of such a device that is effective for ice makers having small storage hoppers; the provision of such a device that continuously makes ice during an ice making portion of an operating cycle; the provision of such an ice making device that is automatic in operation; and the provision of such an ice making device that provides quality ice.

The present invention involves the provision of an ice dispenser having an ice former with an outlet. Ice is discharged from the outlet on command into a hopper positioned for receiving ice discharged from the outlet. A low ice level sensor is operatively associated with the hopper and is operable to monitor a first parameter of the ice dispenser, the first parameter being indicative of a low ice level in the hopper. A controller is operably connected to the ice former and the low ice level sensor and is operable to monitor a second parameter of the ice dispenser, the second parameter being indicative of an operating condition of the ice dispenser. The controller is also operable to reenable the ice former for full discharge of ice by the ice former to the hopper in response to the first and second parameters.

The present invention also involves the provision of an ice making device comprising an ice dispenser having an ice former. The ice former has an outlet and is adapted for discharging ice from the outlet on command. The ice dispenser also has a hopper positioned for receiving ice discharged from the outlet and a feeder associated with the hopper operable to feed ice to a discharge for dispensing ice from the hopper. A low ice level sensor is operatively associated with the hopper and operable to monitor a first parameter of the ice dispenser, the first parameter being indicative of a low ice level in the hopper. The low ice level sensor is operable to generate a low ice level signal. A high ice level sensor is operatively associated with the hopper and operable to monitor a second parameter of the ice dispenser. The second parameter is indicative of a high ice level in the hopper and the high ice level sensor is operable to generate a high ice level signal. A controller is operably connected to the ice former, the low ice level sensor and the high ice level sensor and is operable to monitor third parameters of the ice dispenser. The third parameters are indicative of operating conditions of the ice dispenser and include the number of times ice has been dispensed from the hopper and a time period. The controller is operable to reenable the ice former for full discharge of ice by the ice former to the hopper in response to the first parameter and at least one of the third parameters meeting a respective predetermined value.

Additionally, the present invention involves the provision of a method of making ice in an ice making device having a hopper and dispensing ice from the hopper. The method includes making ice and discharging the ice at a full discharge rate to the hopper. At least two ice making parameters are monitored, one of which is ice level in the hopper. Full discharge of ice to the hopper is terminated when the ice level reaches a predetermined high ice level. Full discharge of ice to the hopper is reenabled when at least two ice making parameters each meet a respective predetermined value.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 2:
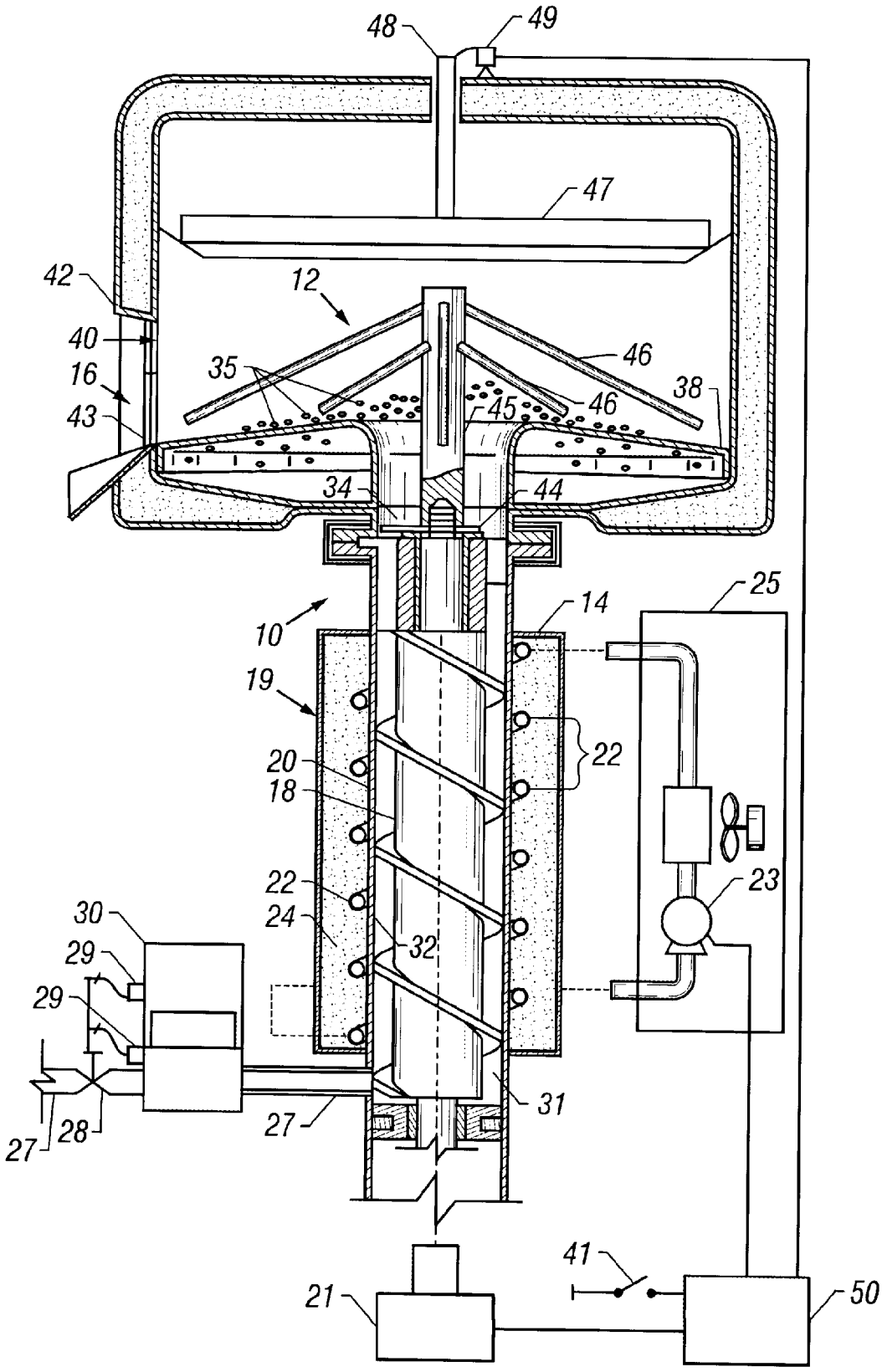
FIG. 2 is side elevation sectional view of an ice making device with control elements shown schematically.

The reference numeral 10 designates generally an ice making device (FIG. 2) comprising an ice storage hopper 12, ice former 14 and ice dispenser 16. A preferred ice making device is model 638090900004 from IMI Cornelius. The ice former 14 includes an auger shaft 18 rotatably mounted in a tube 20. The auger 18 is driven by a motor 21 operably connected thereto. A freezer section 19 includes refrigeration coils 22 surrounding the tube 20 and operably connected to a refrigeration unit 25 that includes a compressor 23. Insulation 24 in a housing 26 surrounds the coils 22. A water inlet tube 27 communicates with the interior 31 of tube 20. Preferably water flow in the inlet tube 27 is controlled by a water flow control valve arrangement preferably of the float valve type having a water flow control valve 28 and a float chamber 30. One or more switches 29 are operably connected to the valve 28 signaling high and low water levels in the chamber to control the valve 28. Preferably the valve 28 is a solenoid operated valve. Water flows into the space 31 between the auger 18 and the interior surface 32 of the tube 20 and freezes and is fed to a discharge 34 at the upper end of the auger 18. The formed ice 35 breaks into pieces on its own after exiting the tube 20 and is then fed through a bottom opening 36 into the hopper 12. An ice breaker (not shown)could be provided in the tube 20 to assist in ice breakage if desired. The bottom wall 38 of the hopper 12 is frustoconically shaped, sloping downwardly to its outer perimeter. An ice outlet opening 40 is positioned in a sidewall 42 of the hopper 12 and is operable for dispensing ice to a beverage cup or the like. A door 43 is movably mounted on the sidewall 42 and selectively opens and closes the opening 40 upon command. The command includes a dispensing signal generated by a consumer initiating operation by inserting money and making a selection in the case of an automatic beverage dispenser by actuating a switch 41 or the like. Preferably, the door 43 closes after a predetermined elapsed time of dispensing. The auger 18 has an upper end 44 with a shaft 45 secured thereto. A plurality of paddles 46 are secured to and extend laterally outwardly from the shaft 45. Rotation of the auger 18 and the shaft 45 with the paddles 46 induces ice flow from the hopper 12 through the outlet 40. If the auger 18 is not already rotating because of ice making, the signal from the switch 41 will start the motor 21 to achieve ice dispensing and also open the door 43. After a predetermined time, the door 43 closes and the motor 21 will stop, unless the device 10 is in ice making mode, terminating the dispensing of ice 35 through the opening 40.

Ice level sensing means is provided and is operable to generate signals indicative of a high ice level and a low ice level in the hopper 12. Any suitable sensing means can be used. Preferably, a diaphragm 47 is movably mounted in the hopper 12. The diaphragm 47 has an actuator shaft 48 engageable with a switch 49 such as a limit switch. The diaphragm 47 rests on the ice 35 indicating generally the level of the top surface of the pile of ice in the hopper 12. When the top surface of the ice pile reaches a predetermined high level in the hopper 12, ID the switch 49 generates a signal such as by making or breaking a circuit indicative of a high ice level. When the ice level lowers from ice dispensing, the diaphragm 47 moves down in the hopper 12 until it reaches a predetermined low level again activating the switch 49 to generate a second signal such as by breaking or making a circuit (the opposite of the switch generating the high ice level signal) indicative of a predetermined low ice level. The diaphragm 47 and switch 49 form both high and low ice level sensors. Other forms of ice level sensors could be used. For example a swing arm arrangement like those used in home refrigerator ice makers could be used. A two switch arrangement could also be used.

A controller 50 is operably connected to various components of the ice making device 10 to control the operation thereof. The controller 50 operates in a manner shown in FIG. 1. Preferably, the controller 50 is a programmable logic circuit device as are known in the art. Ice making is commenced by activating the refrigeration unit 25 and feeding water into the space 31. The motor 21 is also activated driving the auger 18 to move formed ice 35 to and out the outlet 34 and bottom opening 36. The formed ice 35 is discharged into and fills the hopper 12 until a high ice level signal is generated by ice reaching the high ice level thereby activating the sensor 49. When the high ice level signal is generated, the manufacture of ice is at least partially and preferably completely terminated stopping full ice discharge to the hopper 12 (i.e. the production of ice at a generally normal rate). The operation of the ice making device 10 will be discussed in terms of ice making being completely temporarily stopped when the ice 35 in the hopper 12 reaches a predetermined high level as sensed by the high ice level sensor 49. It is to be understood that the making of ice could be, alternatively, slowed down substantially to stop full ice discharge, for example less than about 20% of normal ice production rates. Ice making ceases when the high level sensor 49 is activated.

The high ice level signal, which can be the making or breaking of a circuit, is indicative of a high ice level and is transmitted to the controller 50 and disables the motor 21 and hence the auger 18 and the compressor 23 of the refrigeration unit 25. Ice 35 is dispensed from the hopper 12 through the opening 40 from time to time. For ice dispensing, the motor 21 is reactivated to drive the auger 18, shaft 45 and paddles 46 to help move ice to the opening 40. When the ice 35 reaches a predetermined low level in the hopper 12, the low level ice sensor 49 generates a signal indicative of the low ice level which could be the making or breaking of a circuit. The controller 50 is further operable to monitor an additional parameter indicative of a second operating condition of the ice making device 10. The second operating condition can be indicative of current and/or former operating conditions. The controller 50 is operable to reenable the ice forming auger 18 for full discharge of ice 35 by the ice former 14 to the hopper 12 in response to the low level signal and the second operating condition. When the second operating condition reaches a predetermined value and the low ice level signal indicates low ice, the ice former 14, including the auger 18, will be reenabled for full discharge of ice to the hopper 12. The second operating condition can be any suitable operating condition, e.g., elapsed time, the length of time ice has been dispensed, i.e. the total or cumulative amount of elapsed time during which one or more ice has been dispensed since a starting point, number of dispenses of ice from the hopper 12, etc. Some second operating conditions are monitored from a starting point. Preferably, the starting point is the generation of the low ice level signal, however, it could also be measured from the generation of the full ice level signal. Also, more than one operating condition can be monitored and can be used individually or in combination for reenabling full discharge of ice.

It has been found desirable to initiate a time delay (as described below) when the low ice level signal is generated. When ice storage hoppers have small storage capacities, as is typically the case for automated beverage dispensers which can have a full capacity on the order of four lbs., it has been found desirable to generate the low ice level signal when the hopper 12 has ice in the range of about 40% through about 80%, preferably in the range of about 50% through about 70% and most preferably about 60% of the capacity at the full ice level as indicated by the high ice level sensor 49. The degree of ice fill in the hopper 12 to initiate the low ice level signal will depend on the size of hopper relative to the rate of ice dispensing. Having a significant amount of ice in the hopper 12 provides for the use of a small hopper and dispensing of high quality ice while being able to meet demand for ice. The initiation of a predetermined time delay period with a significant amount of ice in the hopper 12 allows the hopper to be further emptied without jeopardizing the ability to meet demand. typical time delay would be in the range of about ½ hour through about 4 hours, preferably in the range of about 1 hour through about 3 hours and most preferably about 2 hours of elapsed time since the most recent low ice level signal (starting point).

Figure 1:
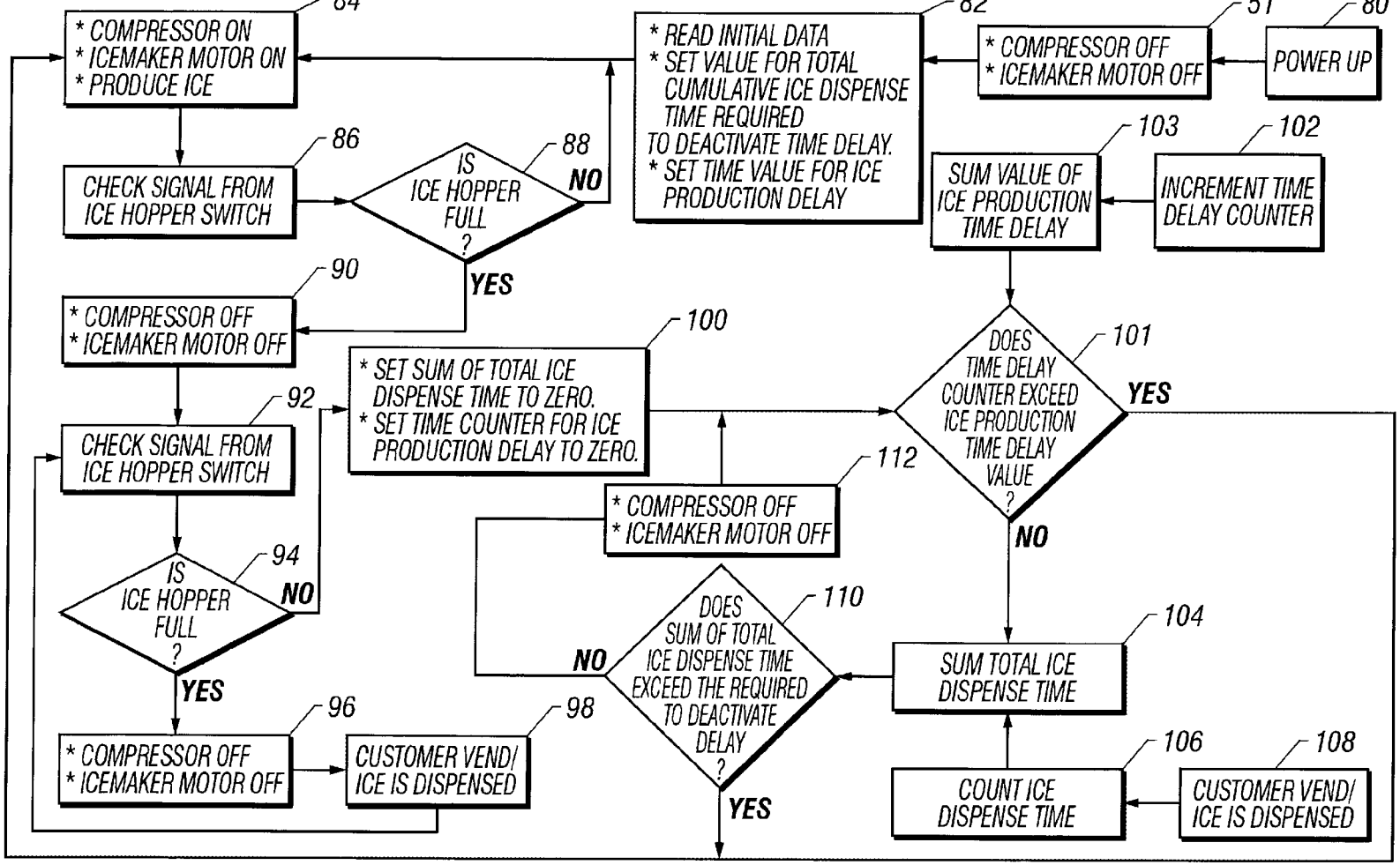
FIG. 1 is an operation flowchart of a controller for an ice making device.

Other second operating conditions that can be monitored include the amount of time ice 35 is dispensed and the number of times ice has been dispensed through the opening 40 since the last low ice level signal (starting point). Both are indicative of the quantity of ice that has been dispensed. Preferably, the amount of time of ice dispensing is used as a second operating condition. The ice dispensing time is measured by measuring the length of time the door 43 is open. In a preferred embodiment, the aforementioned time delay period is initiated by the low ice level signal during which time period full ice discharge is disabled until another operating condition is met. As seen in FIG. 1, full ice discharge is reenabled when either the time delay period has elapsed, as described above, or within the time delay period upon meeting another operating condition as described above. When the operating conditions are met, the controller 50 effects commencement of operation of the ice former 14 for full ice discharge to the hopper 12 by activating the compressor 23 and powering the motor 21 to drive the auger 18. Full discharge of ice is continued until the ice reaches and activates the high ice level sensor 49. When the high ice level sensor 49 is activated, the full discharge of ice is again ceased. In the described preferred embodiment, the ice making cycle starts again upon receipt of the low ice level signal. It is to be understood that the controller 50 can be programmed for a variety of operating modes, for example, cycle initiation could be the high ice level signal. Rate of ice dispenses could be monitored instead of or in addition to the number of dispenses or total time of dispensing. If the ice making device 10 is used in an environment where there are regular periods of non operation, the controller 50 could be programmed for preselected time periods of stand-by mode such as date, e.g., weekends, holidays, e.g., Thanksgiving, day of week, e.g., weekends, and/or time of day, e.g., early morning hours, when consumers would not normally be present. During such stand-by periods, the ice former 14 would be disabled from full discharge of ice irrespective of the other operating parameters and control functions effected by the controller 50 for normal operation. The controller 50 operates on an ice making cycle basis. A cycle of ice making is between common operating points in successive cycles, e.g., the period between two successive high ice level signals, which is a preferable operating mode, or between two low ice level signals. When an ice making cycle is completed, the controller 50 resets itself for another cycle. The monitoring of the operating conditions will be reinitiated at the appropriate signal and the monitored operating conditions will be remeasured.

The operation of the controller 50 is illustrated in FIG. 1. The operation of the ice making device 10 is described below using a time delay period and the amount of elapsed time of ice dispensing as monitored operating parameters for control of the ice making device. The ice making device 10 is powered up, control box 80, and the compressor 23 and motor 21 are off, control box 51. The controller 50 is preprogrammed with initial operating parameter data, control box 82, with the total cumulative elapsed time of ice dispensing required to disable the time delay period and the time delay period are set. Ice making commences by activating the compressor 23 and the motor 21, control box 84. The controller 50 checks the ice level signal, control box 86, and evaluates the signal for whether or not the hopper 12 is full, control box 88. If the hopper 12 is not full, ice making continues and if it is full, the compressor 23 and motor 21 are disabled from producing full discharge of ice 35, control box 90. After the motor 21 and compressor 23 are disabled, the controller 50 checks the signal from the ice level switch 49 and determines if the hopper 12 is full, control box 94. If the hopper 12 is fill, the compressor 23 and motor 21 are maintained disabled, control box 96. If a signal from the switch 41 is received, control box 98, the controller 50 rechecks the level of ice in the hopper 12, control boxes 92, 94. If the hopper 12 is not full, control box 94, the total time of ice dispensing is set to zero and the time delay period is also set to zero, control box 100. The controller 50 evaluates whether or not the time delay period, after resetting to zero now exceeds the predetermined time delay period, control box 101. The elapsed time of the time delay period, control box 102, is summed or monitored, control box 103. If the predetermined time delay period is exceeded, the compressor 23 and motor are reenabled for full discharge of ice 35, control box 84. If the time delay period has not expired or been exceeded, the controller 50 determines the total time of dispensing of ice 35 from multiple dispenses through the opening 40, control box 104. The value of the time of ice dispensing is provided by measuring the total time the door 43 is open for multiple ice dispenses, control box 106, as initiated by a signal generated by activating the switch 41, control box 108. The controller 50 determines if the amount of time of ice dispensing exceeds a predetermined value, control box 110. If the cumulative time of ice dispensing exceeds the predetermined value, the time delay is disabled and the compressor 23 and motor 21 are reenabled for full ice discharge, control box 84. If the time of ice dispensing does not reach the predetermined value set therefor, the compressor 23 and motor remain disabled, control box 112.

When introducing elements of the present invention or the preferred embodiment(s) thereof, the articles "a," "an,"

"the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An ice making device comprising:

an ice dispenser, said ice dispenser having an ice former, said ice former having an outlet and being adapted for discharging ice from the outlet on command, said ice dispenser further having a hopper positioned for receiving ice discharged from the outlet and a feeder associated with the hopper operable to feed ice to a discharge for dispensing ice from the hopper;

a low ice level sensor operatively associated with the hopper and operable to monitor a first parameter of the ice dispenser, said first parameter being indicative of a low ice level in the hopper and said low ice level sensor being operable to generate a low ice level signal;

a high ice level sensor operatively associated with the hopper and operable to monitor a second parameter of the ice dispenser, said second parameter being indicative of a high ice level in the hopper and said high ice level sensor being operable to generate a high ice level signal;

a controller operably connected to the ice former and the low ice level sensor and the high ice level sensor and operable to monitor third parameters of the ice dispenser, said third parameters being indicative of operating conditions of the ice dispenser, said third parameters including a time period and a quantity of ice dispensed from the hopper and, said controller being operable to reenable the ice former for full discharge of ice by the ice former to the hopper in response to the first parameter being met and at least one of the third parameters meeting a respective predetermined value.

2. An ice making device as set forth in claim 1 wherein the third parameter being met when a predetermined time delay period expires.

3. An ice making device as set forth in claim 2 wherein said time delay period commences upon generation of the low level signal.

4. An ice making device as set forth in claim 2 wherein said time delay period commences upon generation of the high ice level signal generated by the high ice level sensor.

5. An ice making device as set forth in claim 1 wherein ice is dispensed from the hopper a number of times during an operating cycle of the ice making device and said third parameter is met when a predetermined number of dispenses is met.

6. An ice making device as set forth in claim 5 wherein the number of dispenses being counted commences with the low ice level signal being generated.

7. An ice making device as set forth in claim 5 wherein the number of dispenses being counted commences with the high ice level signal being generated.

8. An ice making device as set forth in claim 1 wherein ice is dispensed multiple times from the hopper for a period of total time of multiple ice dispenses during an operating cycle of the ice making device and said third parameter is met when a predetermined period of total time of ice dispenses is met.

9. An ice making device as set forth in claim 8 wherein the period of time of ice dispensing commences with the low ice level signal being generated.

10. An ice making device as set forth in claim 8 wherein the period of time of ice dispensing commences with the high ice level signal being generated.

* * * * *